United States Patent [19]

Aizawa

[11] 4,094,136

[45] June 13, 1978

[54] ELECTRONIC TIMEPIECE INSPECTION CIRCUIT

[75] Inventor: Hitomi Aizawa, Suwa, Japan

[73] Assignee: Kabushiki Kaisha Suwa Seikosha, Tokyo, Japan

[21] Appl. No.: 753,129

[22] Filed: Dec. 22, 1976

[30] Foreign Application Priority Data

Dec. 24, 1975 Japan ..... 50-154284

[51] Int. Cl.[2] ..... G04C 3/00

[52] U.S. Cl. ..... 58/23 R; 58/85.5

[58] Field of Search ..... 58/23 R, 23 A, 4 A, 58/23 AC, 50 R, 85.5

[56] References Cited

U.S. PATENT DOCUMENTS

| | | | |
|---|---|---|---|
| 3,733,810 | 5/1973 | Girard | 58/4 A |
| 3,855,782 | 12/1974 | Mishimura et al. | 58/23 R |
| 3,889,459 | 6/1975 | Lu | 58/23 AC |
| 4,001,553 | 1/1977 | Troutman et al. | 235/92 MS |

*Primary Examiner*—Robert K. Schaefer
*Assistant Examiner*—Vit W. Miska
*Attorney, Agent, or Firm*—Blum, Moscovitz, Friedman & Kaplan

[57] ABSTRACT

An inspection circuit for facilitating the inspection of the components of an electronic timepiece at the time that same is manufactured is provided. The inspection circuit is provided in an electronic timepiece having oscillator circuitry for producing high frequency time standard signals and divider circuitry for dividing down the high frequency time standard signal and producing a lower frequency time standard signal. The electronic timepiece further includes timekeeping counter circuitry for producing timekeeping signals and a digital display for displaying time in response to the timekeeping signals being applied thereto. The inspection circuit of the instant invention is particularly characterized by an auto-clear circuit coupled to the timekeeping counter and divider circuitry for detecting a power-on condition and in response thereto, applying a reset signal to the divider and timekeeping counter circuitry to thereby reset the counts thereof. The inspection circuit is coupled intermediate the divider timekeeping counter and divider circuitry and is adapted to receive the reset signal and apply to the digital display a first inspection signal to permit a first inspection of the digital display to be effected until the flower frequency time standard signal is applied to the inspection circuit.

9 Claims, 14 Drawing Figures

FIG. 3a
FIG. 3b
FIG. 3c
FIG. 3e
FIG. 3f
FIG. 3g
FIG. 3k
FIG. 3l
FIG. 3m
FIG. 3d
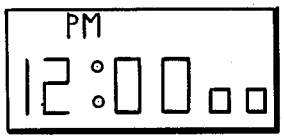
FIG. 4
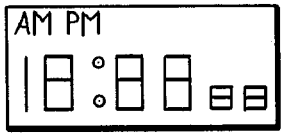
FIG. 5

ELECTRONIC TIMEPIECE INSPECTION CIRCUIT

BACKGROUND OF THE INVENTION

This invention is directed to a fully electronic timepiece, and in particular to an inspection circuit that permits the operative components of an electronic timepiece to be readily inspected during, and at the completion of, the manufacturing of the electronic timepiece.

In recent years, the development of electronic wristwatches has been coupled with the development of new IC fabrication techniques, thereby permitting the entire electronic timepiece to be fabricated on a single IC chip or, alternatively, a few IC ships. Moreover, as a result of such improved IC techniques, small sized, highly accurate electronic wristwatches are now being manufactured at a moderate cost. Moreover, many additional functions can be performed by such small sized timepieces, such as displaying calendar information, calculator information, and the like. However, these additional functions cause the IC circuits to be extremely complex, thereby requiring considerable time and expense to inspect the electronic timepiece circuitry and other components when the timepiece is manufactured.

Among the items that must be inspected, at considerable expense to the manufacturer, are breaks in the electrodes in the time display portion, breaks at the outputs of the electronic timekeeping circuitry and the indexing operation of the timekeeping counters. Heretofore, detailed and unrealted inspection steps, including the application of signals to the respective leads, have been utilized. Such inspection procedures are particularly difficult when the digital display portion and the electronic timekeeping circuit portion of the timepiece are formed on a single IC chip. Other difficulties encountered in inspecting the electronic timepiece include determining the current consumption during operation of the timepiece, once same is assembled. Accordingly, an inspection circuit for an electronic timepiece, that facilitates inspection of the operative components thereof, at the time of manufacture, is provided.

SUMMARY OF THE INVENTION

Generally speaking, in accordance with the invention, an improved inspection circuit for an electronic timepiece is provided. The electronic timepiece includes an oscillator circuit for producing a high frequency time standard signal and a divider circuit for receiving the high frequency time standard signal and producing a lower frequency time standard signal in response thereto. A timekeeping counter is provided for producing timekeeping signals representative of actual time in response to a lower frequency time standard signal being applied thereto. A digital display is adapted to display time in response to the timekeeping signals produced by the timekeeping counter being applied thereto. Accordingly, the inspection circuit of the instant invention is particularly characterized by an auto-clear circuit coupled to the timekeeping counter and divider circuitry for detecting a power-on condition and in response thereto applying a reset pulse signal to the timekeeping counter circuit and divider circuit to reset the counts thereof. The inspection circuit is coupled intermediate the divider circuit and timekeeping counter and is adapted to receive the reset signal and in response thereto, apply a first inspection signal to the digital display for effecting a first inspection thereof until the lower frequency time standard signal is applied to the inspection circuitry at a predetermined interval of time after the reset signal is produced.

Accordingly, it is an object of the instant invention to include inspection circuitry in the electronic timepiece circuitry for automatically effecting an inspection of the timekeeping circuitry at a time that manufacturing of the timepiece is effected, or shortly thereafter.

Still a further object of the instant invention is to simplify the inspection of the operative components of a completely electronic timepiece at times other than normal use.

Still another object of the instant invention is to provide an improved electronic timepiece inspection circuit that is operative only in response to detecting a power-on condition.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. *3a, 3b, 3c, 3e, 3f, 3g, 3k, 3l, 3m* and *3d* represent comparative wave diagrams of the operation of the electronic timepiece circuitry depicted in FIG. 2; and FIGS. 4 and 5 are illustrative views of time displayed by the decoder, driver and display illustrated in FIG. 1 during different inspection operations.

DETAILED DESCRIPTION OF THE PREFERRED EMBODIMENTS

Figure 1:
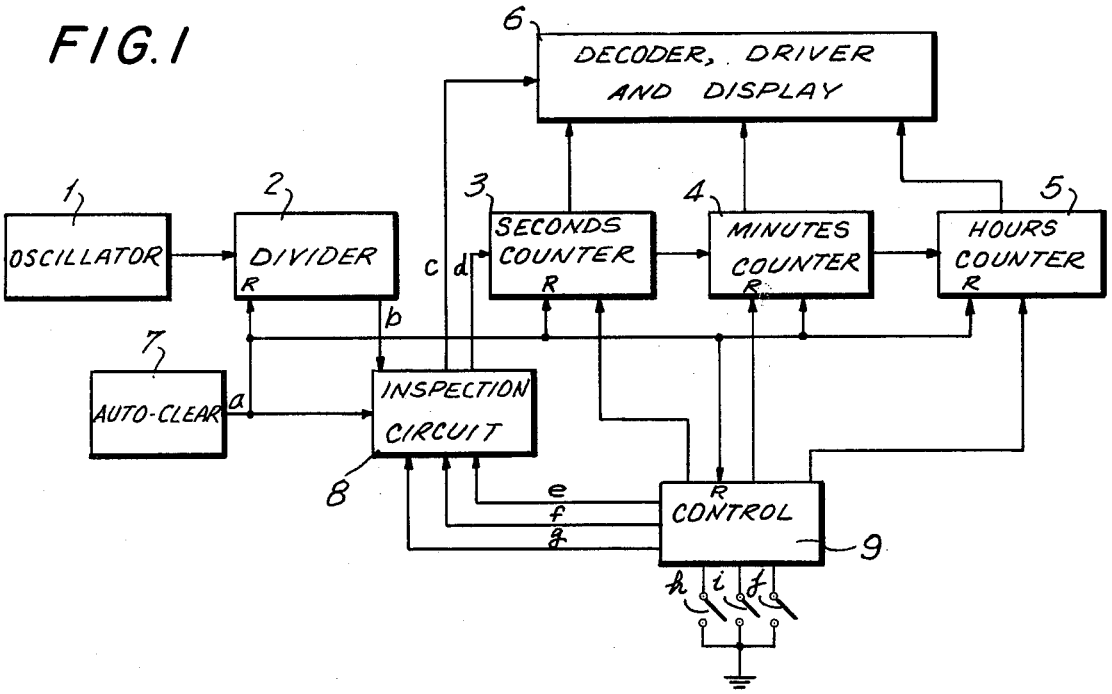
FIG. 1 is a block circuit diagram of an electronic timepiece including an inspection circuit, constructed in accordance with the instant invention.

Reference is now made to FIG. 1, wherein an electronic timepiece, including inspection circuitry of the type to which the instant invention is directed, is depicted. Oscillator circuit 1 includes a high frequency time standard, such as a quartz crystal vibrator, for producing a high frequency time standard signal on the order of $2^{16}$Hz. The high frequency time standard signal is applied to a divider circuit 2, which circuit has a division ratio of $\frac{1}{2}^{16}$, for dividing down the high frequency time standard signal and applying a one-second low frequency signal *b* to inspection circuit 8. As is explained in greater detail below, during normal operation, inspection circuit 8 applies a signal *d* to series connected seconds counter 3, minutes counter 4 and hours counter 5, which signal *d* has the same frequency and phase as the one-second signal *b* applied to inspection circuit 8, and in response thereto, the seconds, minutes and hours counters produce timekeeping signals representative of the actual time, in seconds, minutes and hours, respectively. The timekeeping signals produced by the respective counters are applied to a decoder, driver and digital display 6 for effecting a display of the time counted by the seconds counter, minutes counter and hours counter. An auto-clear circuit 7 is coupled to the inspection circuit 8 and to the reset terminals R of the divider circuit 2, seconds counter 3, minutes counter 4, hours counter 5 and control circuit 9. The auto-clear circuit 7 is adapted to detect a power-on condition and, in response thereto, apply a reset signal to the reset terminals R of the respective counters, divider circuit and control circuit. Finally, control circuit 9 includes manually operated switches *h, i* and *j* coupled thereto, which switches respectively apply correction signals to the seconds counter 3, minutes counter 4 and hours counter 5 in a conventional manner when the timepiece is in a normal operating mode. Additionally, as is set forth in detail below, the manually operated switches *h, i, j* are further adapted to respectively apply control signal *e, f* and *g* to the inspection circuit 8, during a predetermined inspection period determined by the auto-clear circuit 7 and inspection circuit 8 in order to effect inspection of the electronic timepiece movement in a manner to be described in greater detail below.

Figure 2:
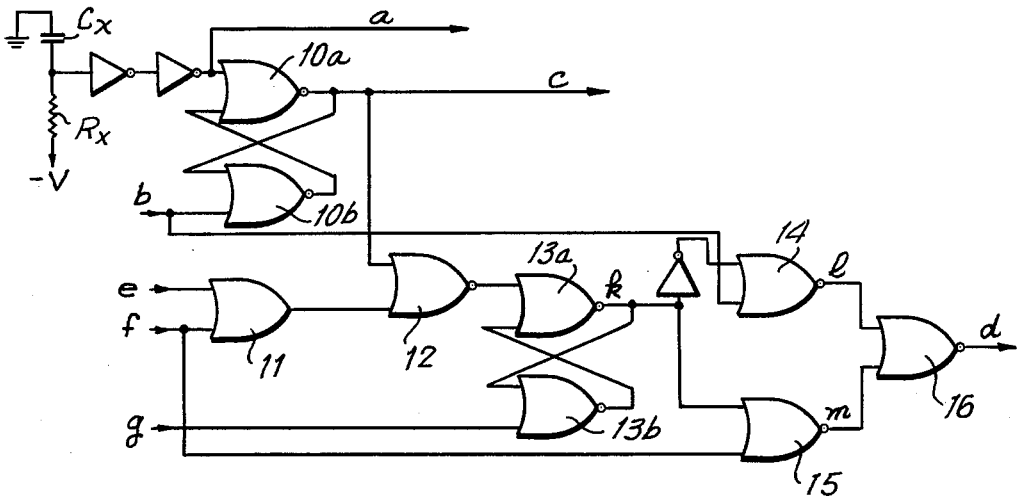
FIG. 2 is a detailed logic diagram of the auto-clear circuit and inspection circuit depicted in FIG. 1.

Referring specifically to FIG. 2, the auto-clear circuit 7 and inspection circuit 8 are illustrated in detail. Moreover, the respective signals received by the inspection circuit 8, and produced by the inspection circuit 8, are illustrated by *a, b, c, e, f, g, k, l, m, d,* which lower case letters correspond to the signals illustrated in FIGS. 3*a* through 3*d*, respectively, illustrated in FIG. 2. Accordingly, reference to a signal having a particular lower case letter will refer to the corresponding wave illustration in FIGS. 3*a* through 3*d*. The auto-clear circuit 7 includes an RC circuit having a resistor $R_x$ and a capacitor $C_x$ for applying a pulse through two series coupled inverter-amplifiers to thereby produce a reset pulse signal *a* in response to detecting a power-on condition. As illustrated in FIG. 2, when the power source (−V) is coupled to the resistor $R_x$, the RC circuit formed by the resistor $R_x$ and capacitor $C_x$, cause a reset pulse signal to be produced having a HIGH level pulse width for a period of time determined by the time constant of the RC circuit. It is noted that a switch (not shown) can be disposed intermediate the power source and the RC circuit for further facilitating when the auto-clear circuit will detect a power-on condition, but such a feature is clearly a convenience feature and is not necessary since power-on cannot be detected until the power source (−V) is coupled to the electronic timepiece circuitry, which circuitry includes the auto-clear circuit.

When the HIGH level reset pulse signal *a* is produced by the auto-clear circuit 7, in response to detecting the power-on condition, the reset pulse signal is applied to the reset terminal R of the divider circuit 2, second counter 3, minutes counter 4, hours counter 5 and control circuit 9, to thereby effect a resetting of the respective circuits receiving the reset signal to a predetermined count. Under normal circumstances, the resetting of each of the above listed circuits would produce a display of 12:00.00-PM, as is illustrated in FIG. 4. Nevertheless, the instant invention utilizes a period of time when the power-on condition is first detected to inspect each of the display digits of the digital display in order to assure that same are fully operative. Specifically, when the HIGH level reset pulse is produced, a HIGH level signal is applied to an input of NOR gate 10*a*, which NOR gate, along with NOR gate 10*b*, comprises a set-reset flip-flop. Moreover, the application of the reset signal to the divider circuit 2 resets the divider circuit to a count of zero, thereby causing the one-second signal *b* applied to an input of NOR gate 10*b* to be a LOW level signal at that time. In response to the HIGH level signal *a* and LOW level signal *b*, being applied to the NOR gates 10*a* and 10*b* of the set-reset flip-flop, a LOW level signal *c* is applied to the decoder, driver and display, and as long as the signal *c* remains at a LOW level, a lighting of all of the display segments comprising the digital display, in the manner illustrated in FIG. 5 is effected. Accordingly, each of the seven-segmented digital display elements are lit as is the "AM & PM" display and both display segments forming the ten-hour display digit. While each of the display digits is lit in the manner illustrated in FIG. 5, the operation of the display digits can be observed manually or, alternatively, by a light sensor. By such an inspection arrangement, the operation of each of the display segments, and the fact that each of same are properly coupled to the decoder and driver circuitry can be observed. Moreover, 0.5 seconds after the divider circuit 2 is reset by the reset signal *a*, a HIGH level signal *b* is applied to the NOR gate 10*b*, and since the reset signal *a* is now at a LOW level, the output of the set-reset flip-flop is set to a HIGH level, whereafter the first inspection signal *c* remains at an HIGH level. Thus, in response to detecting the power-on condition, the first inspection signal *c* is applied to the decoder driver and display for 0.5 seconds, in order to inspect the digital display elements, after which the digital display is returned to the state illustrated in FIG. 4, whereafter the inspection circuit 8 will permit further inspection operations to be effected. Nevertheless, it is noted that the only time the first inspection signal *c* can be produced is when the power-on condition is detected by the auto-clear circuit and the first inspection signal will only be produced for a predetermined time thereafter. Accordingly, the inspection signal will not be produced during normal use of the electronic timepiece, such as when same is worn by a person as an electronic wristwatch.

As heretofore noted, when the electronic timepiece is in a normal operating mode, the control circuit 9 is disposed in a correction mode, wherein manually operated switches *h, i* and *j* respectively apply correction signals to the seconds counter 3, minutes counter 4 and hours counter 5 to effect correction of the time displayed in a conventional manner. Moreover, the control circuit 9 is also adapted to respectively apply control signals *e, f* and *g* to the inspection circuit 8 in response to the actuation of manually operated switches *h, i* and *j*, when the timepiece is in an inspection mode. As is illustrated in FIGS. 3*e* and 3*f*, in response to the actuation of switches *h* and *i*, differential LOW level pulses are applied to the inspection circuit 8. On the other hand, actuation of manually operated switch *j* provides a bi-stable output signal *g* (FIG. 3*g*), which signal will be maintained at a LOW level until the switch *j* is deactuated. As is detailed below, a second inspection function, whereby the seconds counter is prevented from being counted, and additionally, indexing pulses are applied to the seconds counter to check out the counting cycle of same, is effected in response to actuation of manually operated switches *h, i* and *j*, during the predetermined 0.5 second interval of time that the first inspection operation is taking place.

As aforenoted, the first inspection signal *c* remains at a LOW level until 0.5 seconds after the power-on condition is detected, whereafter same is changed to a HIGH level signal and remains at that level. During the 0.5 second interval, a LOW level signal is applied to NOR gate 11. If, during the 0.5 second interval of time, the differential LOW level pulses of control signals *e* and *f* are coincidentally applied to the respective inputs of OR gate 11, a LOW level signal is applied at the output of NOR gate 11 to NOR gate 12 at the same time that the first inspection signal, referenced at a LOW level, is applied to the other input of NOR gate 12. In response to both input signals of NOR gate 12 being at a LOW level, a HIGH level signal is applied to NOR gate 13*a*, which NOR gate in combination with NOR gate 13*b*, defines a set-reset flip-flop. Moreover, as noted above, if the bi-stable control signal *g*, applied to NOR gate 13*b*, is set to a LOW level, at the same time that the HIGH level signal, produced by NOR gate 12, is applied to NOR gate 13*a*, a LOW level signal *k* is produced at the output of the NOR gate 13*a*. The LOW level output signal *k* is applied through an inverter to NOR gate 14, which gate receives, at its other input, the one-second signal *b* produced by divider circuit 2. Nevertheless, as long as the output signal *k* of the set-reset flip-flop remains at a LOW level, the NOR gate 14, will inhibit the one-second signal *b* from being applied to NOR gate 15, to thereby permit each LOW level differential pulse *f*, applied to the other input of NOR gate 15, to be transmitted through NOR gate 15 as a inverted pulse *m* and thereafter, once again, transmitted and inverted through output NOR gate 16 as a pulse *d*. Accordingly, if switches *h*, *i* and *j* are initially coincidentally actuated during the interval of time that the first inspection operation is being effected, the one-second signal *b* is prevented from being applied to the seconds counter, and instead, the seconds counter is indexed by each actuation of switch *i*, which actuation effects the application of a LOW level differential pulse *f* to the inspection circuit. Because the seconds counter changes count every second, it is usually difficult, in conventional timepieces, to inspect the normal counting operation thereof. However, by utilizing the inspection circuit in the manner described above, the count of the seconds counter is readily inhibited, thereby permitting each counting operation to be inspected, and the power consumption utilized by the seconds counter to be readily inspected. Since the problem of a constantly changing count is not encountered with the minutes counter and hours counter, these counters can be inspected by utilizing the correction switches to insure that same are properly indexed through their entire counting cycle, or alternatively, the inspection circuit illustrated in FIG. 2 can be utilized to index the counters in the same manner discussed above with respect to the seconds counter.

Moreover, once the inspection functions detailed above are completed, and the control signal *g* is returned to a HIGH level by the manually operated switch *j*, the output of the set-reset flip-flop formed by NOR gates 13*a* and 13*b* is set to a HIGH level, thereby referencing the output signal *m* of NOR gate 15 at a LOW level, and thereby permitting the one-second signal *b* to be transmitted and inverted by the NOR gate 14. The inverted one-second signal *l*, produced at the output of NOR gate 14, is applied to output NOR gate 16, and is once again inverted and applied as a one-second signal *d* to the input of the seconds counter 3 to thereby effect normal timekeeping operation of the seconds, minutes and hours counters.

In light of the foregoing, it is apparent that the only time that the respective inspection functions can be effected is when the power-on condition is detected, and the simultaneous input of the control signals *e*, *f* and *g* is effected. Thus, the inspection operations can only be performed if the inspection operation is commenced within the first 0.5 seconds after the power source is coupled to the electronic timepiece or, alternatively, when the power is turned on, if a power switch is provided. This arrangement clearly prevents an inspection operation, or change in the display from being inadvertently effected when an electronic wristwatch, constructed in accordance with the instant invention, is being worn during normal use, and also, when correction of the timepiece is effected.

Moreover, the instant invention clearly simplifies and shortens the time required to inspect an electronic timepiece during and after the manufacture of same, and additionally, permits measurement of power consumption, etc., to be performed in a simple and inexpensive manner. Moreover, by avoiding the inadvertent production of inspection signals during normal use of the timepiece, the normal operation of the timepiece is in no way detrimentally effected by the incorporation of the inspection circuitry.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece having oscillator means for producing a high frequency time standard signal, a divider means for receiving said high frequency time standard signal and producing a lower frequency time standard signal in response thereto, timekeeping counter means for producing timekeeping signals representative of actual time in response to said lower frequency time standard signal being applied thereto, and display means for displaying time in response to said timekeeping signals being applied thereto, the improvement comprising auto-clear means coupled to said timekeeping counter means and said divider means for detecting a power-on condition and in response thereto for applying a reset pulse signal to said counter means and divider means to reset the counts thereof, and first inspection means coupled intermediate said divider means and timekeeping counter means, said first inspection means being adapted to receive said reset signal and in response thereto apply a first inspection signal to said display means until said lower frequency time standard signal is applied to said inspection means at a predetermined interval of time after said reset signal is applied to said inspection means so that a first inspection of said display means is effected during said predetermined interval of time.

2. An electronic timepiece as claimed in claim 1, and including second inspection means for receiving said low frequency time standard signal and said first inspection signal, and a control means for selectively applying at least one control signal to said second inspection means, said second inspection means, in the absence of said control signal, being applied thereto during the predetermined interval of time that said first inspection signal is applied thereto, being adapted to apply said low frequency time standard signal to said timekeeping counter means after said predetermined interval of time.

3. An electronic timepiece as claimed in claim 2, wherein said control means is adapted to selectively apply to said second inspection means at least a first control signal and a second control signal, said second inspection means in response to said first and second control signals being coincidentally applied to said second inspection means during the predetermined interval of time that said first inspection signal is applied thereto being adapted to inhibit said lower frequency time standard signal from being applied to said timekeeping counter means until said second control signal ceases being applied thereto.

4. An electronic timepiece as claimed in claim 3, wherein said second inspection means is adapted in the absence of said first inspection signal being applied to said second inspection means and said low frequency time standard signal being inhibited, to apply second inspection signals to said timekeeping counter means in response to each further application of said first control signal to said second inspection means.

5. An electronic timepiece as claimed in claim 4, wherein said control means is adapted to apply a third control signal to said second inspection means, said inspection means being adapted to inhibit application of said lower frequency time standard signal to said timekeeping counter means and to produce a second inspection signal in response to said second control signal being applied thereto, in response to at least said three control signals being applied thereto during said predetermined interval of time.

6. An electronic timepiece as claimed in claim 1, wherein said control means includes three manually operated switches, said respective switches being activated to produce said first, second and third control signals, respectively, said manually operable switches being further adapted to apply correction signals to said timekeeping counter means, when said lower frequency time standard signal is applied to said timekeeping counter means.

7. An electronic timepiece as claimed in claim 1, wherein said auto-clear means include an RC circuit that is adapted to detect a power-on condition by being connected to a power source to thereby detect when said power source begins to deliver a potential thereto, said reset signal having a pulse width determined by the RC constant of said RC circuit.

8. An electronic timepiece as claimed in claim 7, wherein said first inspection means is a set-reset flip-flop, said set-reset flip-flop being adapted to produce said first inspection signal until said lower frequency time standard signal is applied thereto.

9. An electronic timepiece as claimed in claim 8, wherein said display means includes a plurality of digital display elements, each of said digital display elements being lit in response to said first inspection signal being applied to said display means.

* * * * *